US011824259B2

(12) United States Patent
Sakai et al.

(10) Patent No.: US 11,824,259 B2
(45) **Date of Patent: *Nov. 21, 2023**

(54) ANTENNA DEVICE

(71) Applicant: DENSO CORPORATION, Kariya (JP)

(72) Inventors: Toshiya Sakai, Nisshin (JP); Kazumasa Sakurai, Nisshin (JP); Asahi Kondo, Kariya (JP)

(73) Assignee: DENSO CORPORATION, Kariya (JP)

( * ) Notice: Subject to any disclaimer, the term of this patent is extended or adjusted under 35 U.S.C. 154(b) by 495 days.

This patent is subject to a terminal disclaimer.

(21) Appl. No.: 16/794,702

(22) Filed: Feb. 19, 2020

(65) Prior Publication Data

US 2020/0185822 A1 Jun. 11, 2020

Related U.S. Application Data

(63) Continuation of application No. PCT/JP2018/030558, filed on Aug. 17, 2018.

(30) Foreign Application Priority Data

Aug. 21, 2017 (JP) ..... 2017-158690

(51) Int. Cl.

| | |
|---|---|
| ***H01Q 1/38*** | (2006.01) |
| ***H01Q 1/48*** | (2006.01) |
| ***H01Q 1/52*** | (2006.01) |
| ***H01Q 13/10*** | (2006.01) |

(52) U.S. Cl.

CPC ..... *H01Q 1/38* (2013.01); *H01Q 1/48* (2013.01); *H01Q 1/521* (2013.01); *H01Q 13/106* (2013.01)

(58) Field of Classification Search

CPC ..... H01Q 1/38; H01Q 13/106

See application file for complete search history.

(56) References Cited

U.S. PATENT DOCUMENTS 5,539,418 A * 7/1996 Egashira ..... H01Q 9/0464 343/789

5,872,542 A * 2/1999 Simons ..... H01Q 9/0407 343/769

(Continued)

FOREIGN PATENT DOCUMENTS

JP H05-037229 A 2/1993

JP H0537229 A * 2/1993 ..... H01Q 13/08

(Continued)

*Primary Examiner* — Ricardo I Magallanes

(74) *Attorney, Agent, or Firm* — MASCHOFF BRENNAN

(57) ABSTRACT

An antenna device includes a dielectric substrate having a first surface on which an antenna part is formed and a second surface on which a base plate is formed. The antenna part has one or more antenna patterns configured to act as radiating elements. The antenna patterns resonate in one or more resonance directions to incident waves having an operating frequency of the antenna part, thereby generating emitted waves having polarized waves different from those of transmitted/received waves which are transmitted/received by the antenna part. For each of the resonance directions, the antenna patterns include at least one line pattern having a width which is narrower than the total width of the antenna patterns in a direction perpendicular to the resonance direction.

8 Claims, 10 Drawing Sheets

(56) References Cited

U.S. PATENT DOCUMENTS

| | | | | | |
|---|---|---|---|---|---|
| 5,977,924 | A * | 11/1999 | Takei | H01Q 21/068 | 343/770 |
| 11,088,444 | B2 * | 8/2021 | Sakai | H01Q 15/246 | |
| 2002/0047803 | A1 * | 4/2002 | Ishitobi | H01Q 5/357 | 343/700 MS |
| 2006/0017646 | A1 * | 1/2006 | Koide | H01Q 1/38 | 343/702 |
| 2007/0040746 | A1 * | 2/2007 | Song | H01Q 1/1271 | 343/700 MS |
| 2013/0321227 | A1 * | 12/2013 | Ratajczak | H01Q 21/0043 | 343/769 |
| 2016/0359232 | A1 * | 12/2016 | Kawaguchi | H01Q 9/0407 | |
| 2017/0222328 | A1 * | 8/2017 | Fujita | H01Q 17/001 | |
| 2018/0083344 | A1 * | 3/2018 | Han | H01Q 13/106 | |
| 2018/0331432 | A1 * | 11/2018 | Kawaguchi | H01Q 9/045 | |
| 2018/0366831 | A1 * | 12/2018 | Cai | H01Q 9/16 | |
| 2019/0393613 | A1 * | 12/2019 | Kakuya | H01Q 9/045 | |
| 2020/0191904 | A1 * | 6/2020 | Sakurai | H01Q 3/22 | |

FOREIGN PATENT DOCUMENTS

| | | | | | |
|---|---|---|---|---|---|
| JP | H05-152830 | A | | 6/1993 | |
| JP | 2000-013133 | A | | 1/2000 | |
| JP | 2002-290143 | A | | 10/2002 | |
| JP | 2003188636 | A | * | 7/2003 | H01Q 13/08 |
| JP | 2007-208692 | A | | 8/2007 | |
| JP | 2014-103591 | A | | 6/2014 | |

* cited by examiner

ANTENNA DEVICE

CROSS-REFERENCE TO RELATED APPLICATION

The present application is a continuation application of International Application No. PCT/JP2018/030558, filed Aug. 17, 2018, which claims priority to Japanese Patent Application No. 2017-158690, filed Aug. 21, 2017. The contents of these applications are incorporated herein by reference in their entirety.

BACKGROUND

1. Technical Field

The present disclosure relates to an antenna device.

2. Related Art

An antenna for use, for example, in a radar for monitoring the area around a mobile communication device and a mobile body is demanded to be reduced in size. As one of antennas of this type, a planar antenna is known, which includes a printed board having a first surface on which an antenna element is provided and a second surface on which a conductor plate is provided. In this planar antenna, the operation frequency is determined by the size of its antenna element, and the antenna element is smaller as the operation frequency is higher. Briefly, the size of the antenna is mainly determined by the operation frequency.

SUMMARY

The present disclosure provides an antenna device. An antenna device according to one mode of the present disclosure includes a dielectric substrate, an antenna part and a base plate. The antenna device includes the dielectric substrate having a first surface on which the antenna part is formed and a second surface on which the base plate is formed. The antenna part has one or more antenna patterns configured to act as radiating elements. The antenna patterns resonate in one or more resonance directions to incident waves having an operating frequency of the antenna part, thereby generating emitted waves having polarized waves different from those of transmitted/received waves which are transmitted/received by the antenna part. For each of the resonance directions, the antenna patterns include at least one line pattern having a width which is narrower than the total width of the antenna patterns in a direction perpendicular to the resonance direction.

DETAILED DESCRIPTION OF THE PREFERRED EMBODIMENTS

Figure 1:
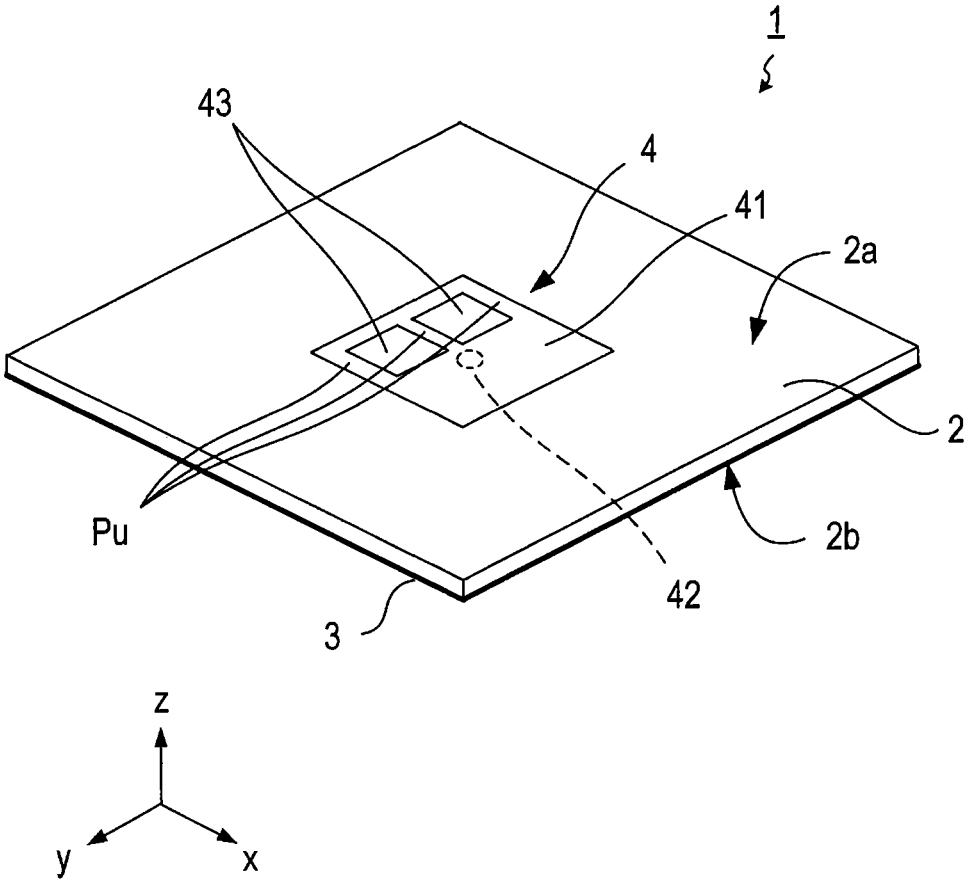
FIG. 1 is a perspective view showing the configuration of an antenna device.

The inventors of the present disclosure have studied the following technique for realizing both reduction in size of an antenna device and suppression of the deterioration in performance caused by manufacturing variations.

For example, JP 2014-103591 A (hereinafter referred to as "PTL 1") discloses a technique of providing a stub line between an antenna element and a conductor plate in a planar antenna, and reducing the size of the antenna element by utilizing the characteristic that the resonance frequency is shifted to a low frequency side by due to the additional capacitance of this stub line.

However, the related art described in PTL 1 has been found to involve the problem that, because of a necessity to provide the stub line within the substrate, labor is required for manufacture.

There has also been found the problem that, if the pattern size of the antenna element is different from the desired size due to manufacturing variations, the resonance frequency would be shifted.

One aspect of the present disclosure resides in providing a technique for realizing both reduction in size of an antenna device and suppression of the deterioration in performance caused by manufacturing variations.

An antenna device according to one mode of the present disclosure includes a dielectric substrate, an antenna part and a base plate.

The antenna part is formed on a first surface of the dielectric substrate and has one or more antenna patterns configured to act as radiating elements. The base plate is formed on a second surface of the dielectric substrate and acts as an antenna ground contact surface. The antenna patterns resonate in one or more resonance directions to incident waves having an operating frequency of the antenna part, thereby generating emitted waves having polarized waves different from those of transmitted/received waves which are electromagnetic waves transmitted/received by the antenna part. For each of the resonance directions, the antenna patterns include at least one line pattern having a width which is narrower than the total width of the antenna patterns in a direction perpendicular to the resonance direction.

According to such a configuration, the capacitance of the antenna patterns reduces, and thus the resonance frequency of the antenna patterns can be reduced. As a result, it is possible to realize a further reduction in external size of the antenna patterns if the same resonance frequency is employed, and, therefore, a reduction in size of the antenna device.

The line of the line pattern becomes long and thin, and the inductance increases, in the case of overetching. The line of the line pattern becomes short and thick, and the inductance decreases, in the case of underetching. The total area of the antenna patterns, i.e., capacitance C decreases with overetching and increases with underetching. That is, in either case, their changes are offset each other. So, it is possible to suppress changes in characteristics caused by manufacturing variations.

Reference numbers in parentheses in the claims indicate correspondences with specific means according to an embodiment which will be described as a mode below, and do not limit the technical scope of the present disclosure.

An embodiment of the present disclosure will hereinafter be described with reference to the drawings.

[1. Configuration]

An antenna device 1 is used, for example, in a millimeter wave radar for detecting various targets which are present on the area around a vehicle. However, the application of the antenna device 1 is not limited to this, and it may be applied, for example, to various instruments and systems required to transmit/receive electromagnetic waves.

The antenna device 1 has a rectangular dielectric substrate 2 as shown in FIG. 1. Hereinafter, a first surface of the dielectric substrate 2 is referred to as substrate front surface 2*a*, and a second surface thereof is referred to as substrate rear surface 2*b*. Further, the direction along a first side of the dielectric substrate 2 is referred to as x-axis direction, the direction along a second side perpendicular to the x-axis direction is referred to as y-axis direction, and the normal direction of the substrate front surface 2*a* is referred to as z-axis direction.

The substrate rear surface 2*b* is provided with a base plate 3 that functions as a ground contact surface. The base plate 3 is a copper pattern covering the entire substrate rear surface 2*b*. The substrate front surface 2*a* is provided with an antenna part 4 near its center.

The antenna part 4 has one or more antenna patterns 41. The individual antenna patterns 41 are copper patterns having a rectangular outer shape. FIG. 1 shows the case where the antenna part 4 includes a single antenna pattern 41 for easily viewing this figure, but the antenna part 4 may include a plurality of the antenna patterns 41.

The antenna pattern 41 is provided with a feed point 42 which receives power supplied to transmit/receive electromagnetic waves whose polarized wave direction is along the x-axis direction. Specifically, in the antenna pattern 41, the feed point 42 is provided at a position located near the center position of the y-axis direction and shifted from the center position of the x-axis direction, i.e., at a position biased in the right front direction of FIG. 1 herein. Power supply to the feed point 42 is configured to be performed by a feed line provided on the side of the substrate rear surface 2*b*, though not shown.

The antenna pattern 41 has two pattern-removed regions 43 formed by removing a part of the antenna pattern 41.

Both of the two pattern-removed regions 43 have a rectangular shape and are arranged on an area having a wide width from the feed point 42 to an outer side forming the outer circumference of the antenna pattern 41 when looking in the x-axis direction from the feed point 42. Also, the two pattern-removed regions 43 are arranged in such a manner that the respective sides defining the boundary of the respective pattern-removed regions 43 are parallel with any of the outer sides of the antenna pattern 41 and that the pattern-removed regions 43 are aligned at a constant interval. Thus, a plurality of line patterns Pu along the resonance direction (i.e., x-axis direction) are formed between the two pattern-removed regions 43 and between each of the pattern-removed regions 43 and the outer side which is parallel to the x-axis of the antenna pattern 41. The line patterns Pu are all narrower than the width of the antenna pattern 41 in a direction (i.e., y-axis direction) perpendicular to the resonance direction. That is, a width of the line pattern Pu is narrower than the width of the antenna pattern 41. The line pattern Pu formed between the two pattern-removed regions 43 is positioned on a virtual line along the resonance direction passing through the feed point 42.

[2. Operation]

Now, the operation frequency of the antenna pattern 41 will be described.

Figure 2:
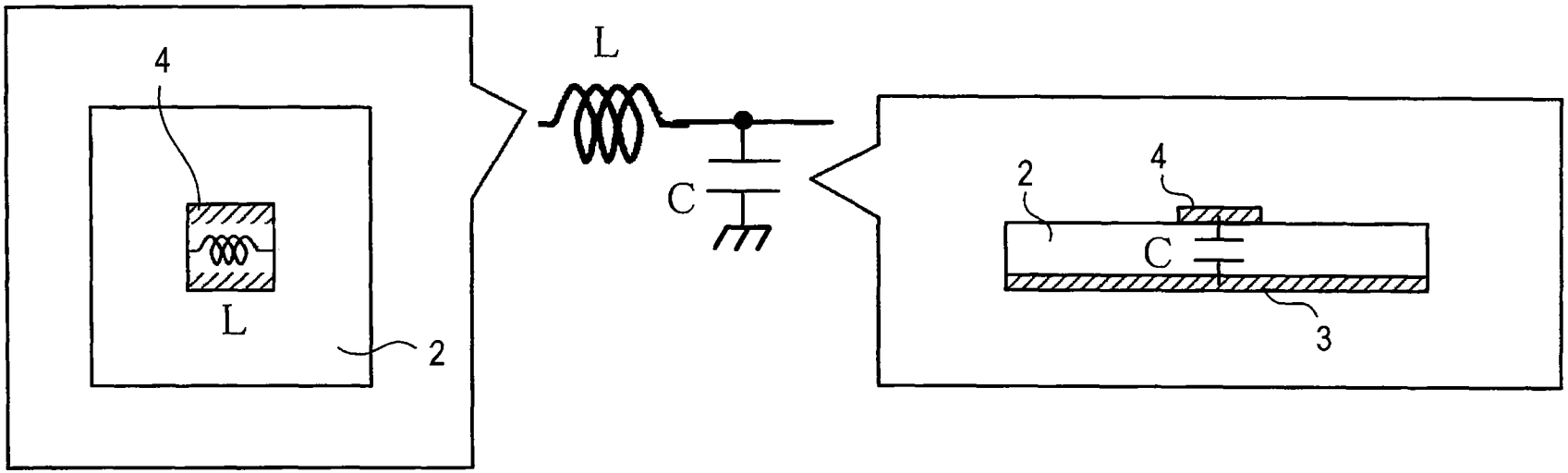
FIG. 2 is an explanatory view regarding a capacitance component and an inductance component to determine an operation frequency.

As shown in FIG. 2, the equivalent circuit of the antenna pattern 41 serves as a serial resonance circuit constituted by a capacitance component C and an inductance component L. Accordingly, the resonance frequency of the antenna pattern 41 is obtained by Formula (1):

[Mathematical Formula 1]

$$f = \frac{1}{2\pi\sqrt{L \cdot C}} \tag{1}$$

The inductance component L is determined depending, for example, on the width and length of the antenna pattern 41 on the assumption that current flows to the antenna pattern 41 in the resonance direction. The capacitance component is formed between the antenna pattern 41 and the base plate 3 and determined depending, for example, on the area of the antenna pattern 41, the thickness of the dielectric substrate 2 and the dielectric constant of the dielectric substrate 2.

Since a line pattern Pu narrower than the width of the outer sides of the antenna pattern 41 is formed by the two pattern-removed regions 43 in the antenna pattern 41, the inductance component L increases. Therefore, if the same external size is employed, the resonance frequency of the antenna pattern 41 having the pattern-removed regions 43 according to the present disclosure reduces as compared with that of a conventional antenna pattern having no pattern-removed region 43. Namely, when an attempt is made to realize the same resonance frequency with the antenna pattern 41 according to the present disclosure and with the conventional antenna pattern, the external size of the antenna pattern 41 can be reduced more. For example, when configured to operate at 24 GHz, the conventional antenna pattern has sides of 3.1 mm, however the antenna pattern 41 according to the present disclosure can have sides of 2.88 mm.

Then, the influence of manufacturing variations on the antenna characteristics will be described.

In a conventional antenna pattern, when the external size of the antenna pattern is smaller than the desired size by overetching, both of L and C decrease. When the changes in L and C are represented as ΔL and ΔC, an operation frequency f is expressed by Formula (2):

[Mathematical Formula 2]

$$f = \frac{1}{2\pi\sqrt{(L-\Delta L)\cdot(C-\Delta C)}} \quad (2)$$

In the case of underetching, the signs of symbols of ΔL and ΔC are inverted.

Figure 3:
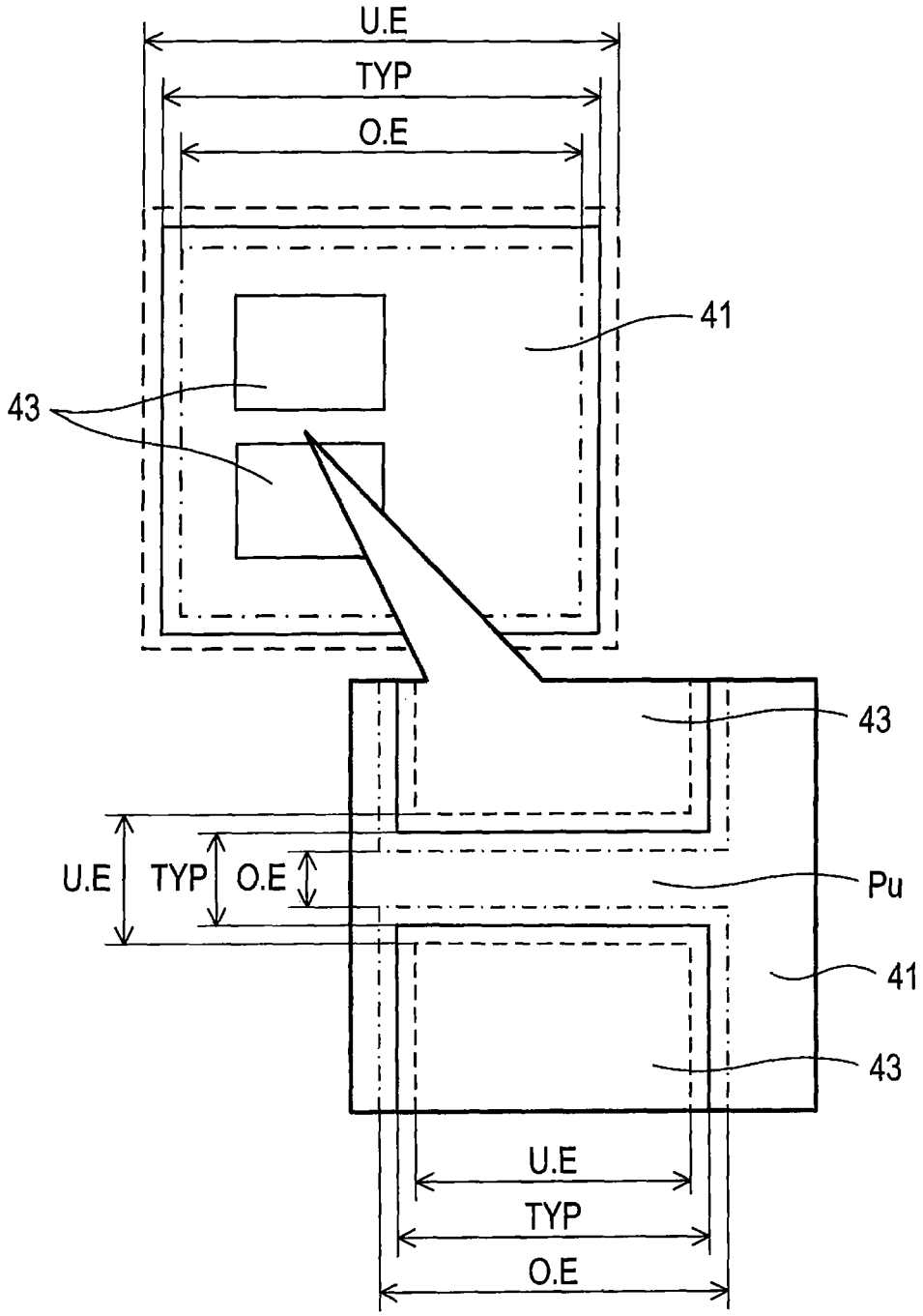
FIG. 3 is an explanatory view showing the influence of manufacturing variations on an antenna pattern.

In the antenna pattern 41 according to the present disclosure, the external size of the antenna pattern 41 is made smaller than the desired size by overetching, as shown in FIG. 3, so that C and an inductance component L1 of a portion other than the line patterns Pu decrease as is the case with the conventional antenna pattern. However, the pattern-removed region 43 is widened by overetching, so that the length of the line patterns Pu increases and the width thereof decreases. So, an inductance component L2 of the line patterns Pu increases. When the changes in C, L1 and L2 are defined as ΔC, ΔL1 and ΔL2, the operation frequency f is expressed by Formula (3):

[Mathematical Formula 3]

$$f = \frac{1}{2\pi\sqrt{(L1-\Delta L1+L2+\Delta L2)\cdot(C-\Delta C)}} \quad (3)$$

In the case of underetching, the signs of symbols of ΔL1, ΔL2 and ΔC are inverted. In FIG. 3, the size as designed is referred to as TYP; the overetched size is referred to as O.E; and the underetched size is referred to as U.E.

Namely, in either case of overetching and underetching, ΔL2 changes in a direction opposite to ΔL1 and ΔC, and thus acts in a direction suppressing change in the operation frequency f. It is desirable that the size of the pattern-removed regions 43 and, therefore, the size of the line patterns Pu be set to satisfy ΔL1<ΔL2 in consideration of a pattern tolerance at the time of manufacture, and further set so that (ΔL1−ΔL2)/(L1+L2) and ΔC/C are equivalent to each other.

[3. Effect]

The embodiment described in detail above provides the following effects.

(1) In the antenna device 1, the antenna pattern 41 includes the plurality of line patterns Pu formed by the plurality of pattern-removed regions 43. So, it is possible to suppress changes in resonance frequency due to the variations in pattern caused during etching, i.e., the manufacturing variations.

Figure 4:
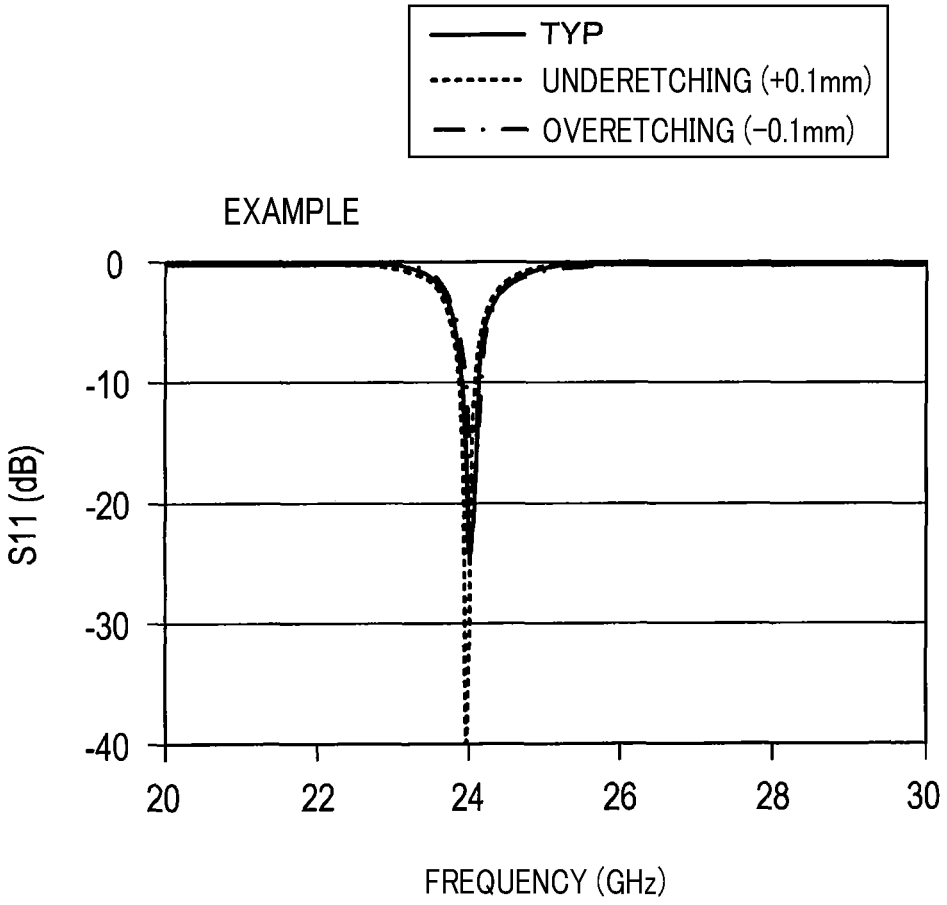
FIG. 4 is a graph showing the influence of the manufacturing variations on the operation frequency in the antenna device according to the present disclosure.
Figure 5:
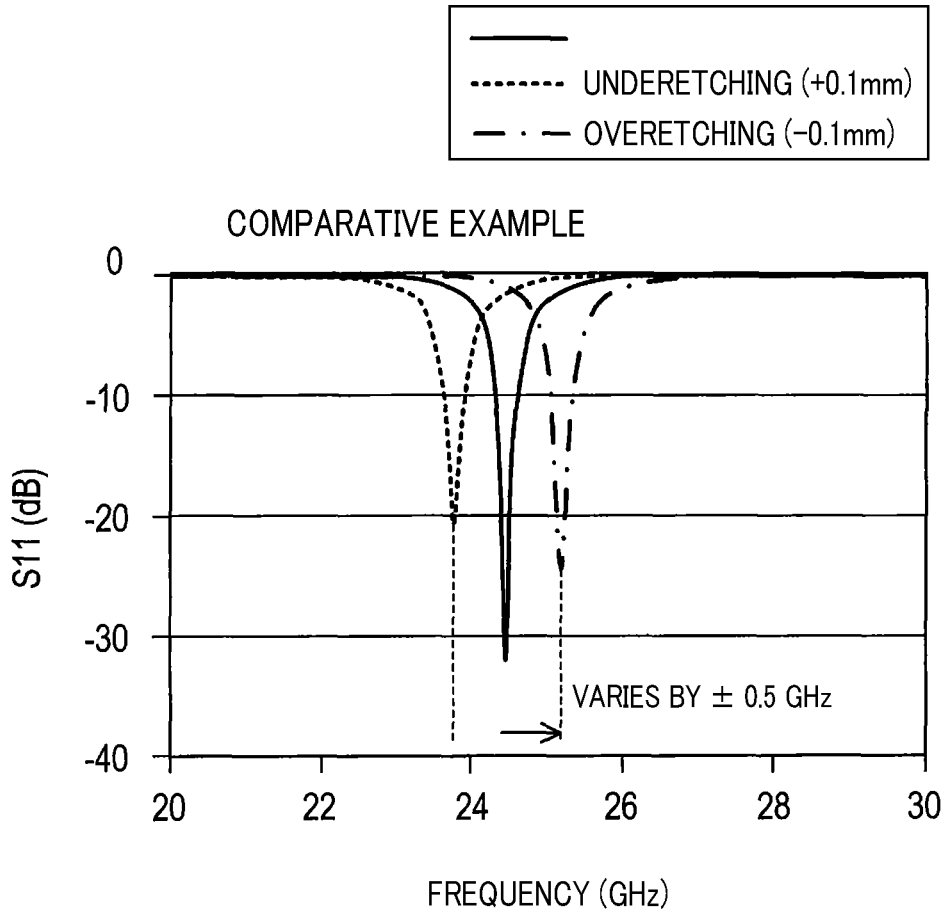
FIG. 5 is a graph showing the influence of the manufacturing variations on the operation frequency in a conventional antenna device.

FIGS. 4 and 5 show results of determination, through simulation, of the frequency characteristics of S parameter S11 of the antenna device 1 by appropriately changing the pattern tolerance which indicates manufacturing variations. Here, the antenna device 1 was designed to operate in the vicinity of 24 GHz, and simulation was performed on TYP when the pattern width was a value as designed (i.e., pattern tolerance: 0 mm), underetching when the pattern width was wider than the designed value (for example, pattern tolerance +0.1 mm) and overetching when the pattern width was narrower than the designed value (for example, pattern tolerance −0.1 mm). FIG. 4 shows the case of an Example of the antenna device 1 according to the present disclosure, and FIG. 5 shows the case of a Comparative Example. In the Comparative Example, a simple square antenna pattern having no pattern-removed region 43 is used in place of the antenna pattern 41 having the pattern-removed regions 43.

As can be seen from FIGS. 4 and 5, S11 is maximum in the vicinity of 24 GHz and the resonance frequency is almost unchanged, regardless of the manufacturing variations, in the Example. However, in the Comparative Example, the frequency at which S11 is minimum is shifted by ±0.5 GHz from 24 GHz, i.e., the resonance frequency greatly changes due to the manufacturing variations.

Figure 6:
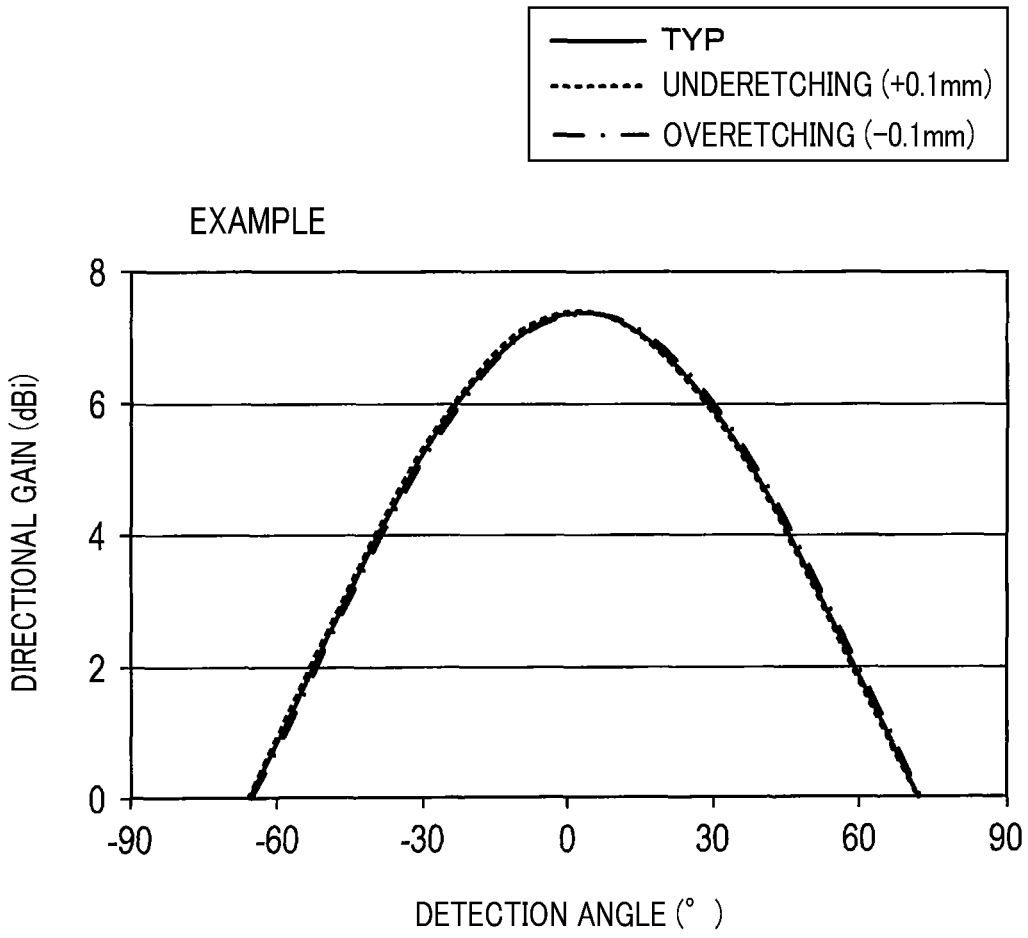
FIG. 6 is a graph showing the influence of the manufacturing variations on directivity in the antenna device according to the present disclosure.
Figure 7:
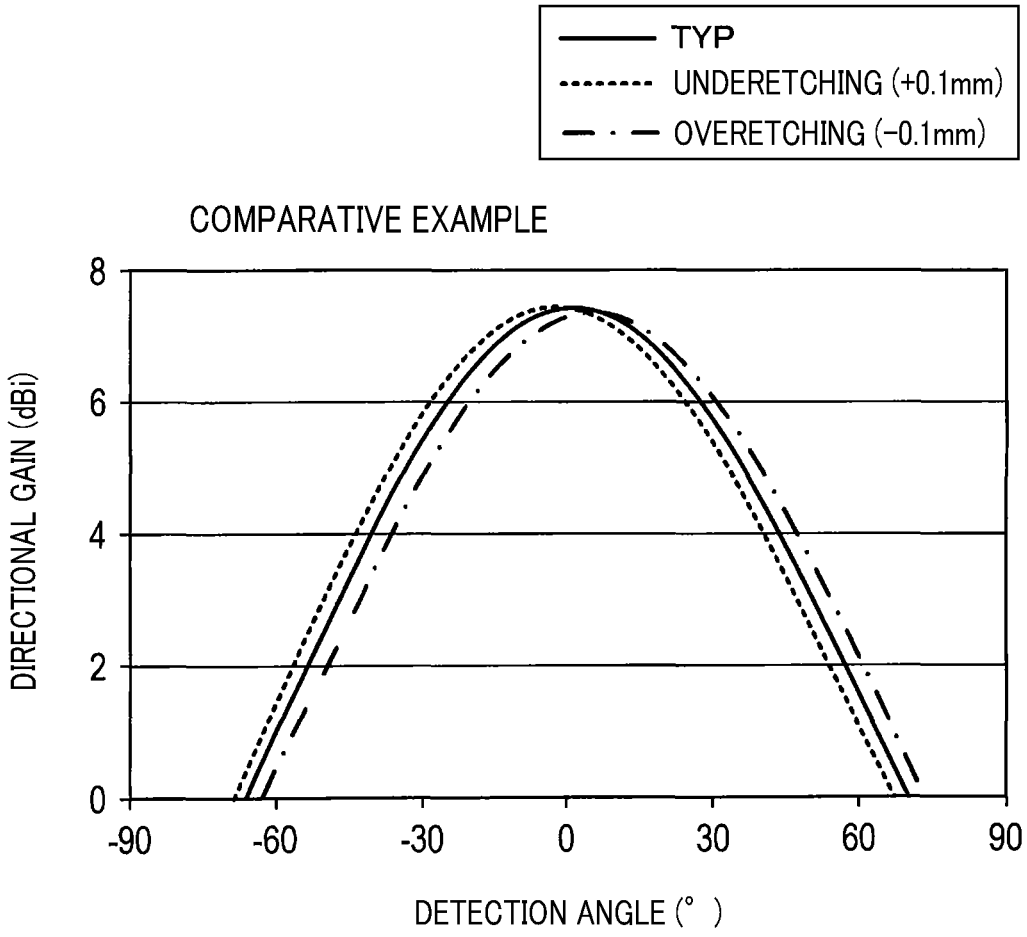
FIG. 7 is a graph showing the influence of the manufacturing variations on the directivity in the conventional antenna device.

(2) FIGS. 6 and 7 show results of calculation, through simulation, of a gain of signals at 24 GHz within a detection angle range of ±90° with respect to the front direction of the antenna (i.e., z-axis direction). Here, simulation was performed on the cases of TYP, underetching and overetching, similarly as for the frequency characteristics of S11 described above. FIG. 6 shows the case of the Example, and FIG. 7 shows the case of the Comparative Example.

As can be seen from FIGS. 6 and 7, the directivity is almost unchanged, regardless of the manufacturing variations, in the Example. However, in the Comparative Example, not only the resonance frequency changes, but also the directivity is shifted by about ±several degrees, due to the manufacturing variations. Hence, in the antenna device 1, stable antenna characteristics are obtained, regardless of the variations at the time of manufacture.

[4. Other Embodiments]

The embodiment of the present disclosure has been described above. However, the present disclosure is not limited to the above-described embodiment, and may be carried out in various modified forms.

Figure 8:
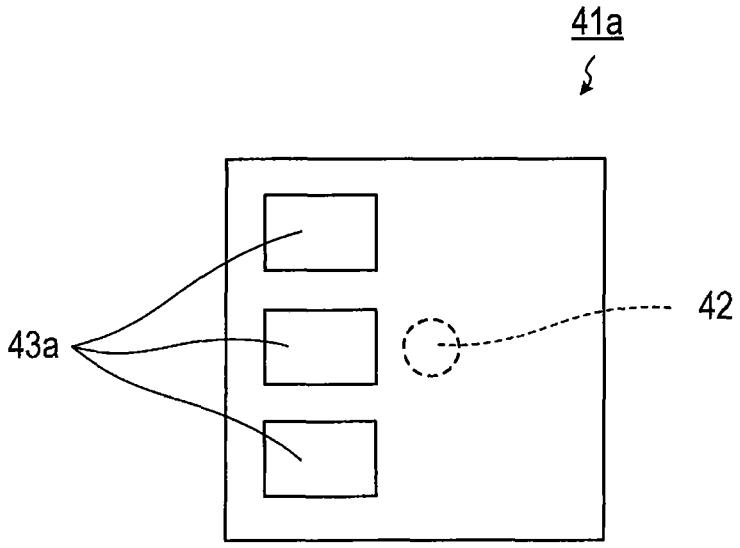
FIG. 8 is an explanatory view showing a variant of the antenna pattern.

(a) The antenna pattern 41 is provided with two pattern-removed regions 43 formed so as to have the same size in the above-described embodiment. However, the present disclosure is not limited to this. For example, the number of pattern-removed regions 43*a* may be 3, not less than 3, or 1, as in an antenna pattern 41*a* shown in FIG. 8.

Figure 9:
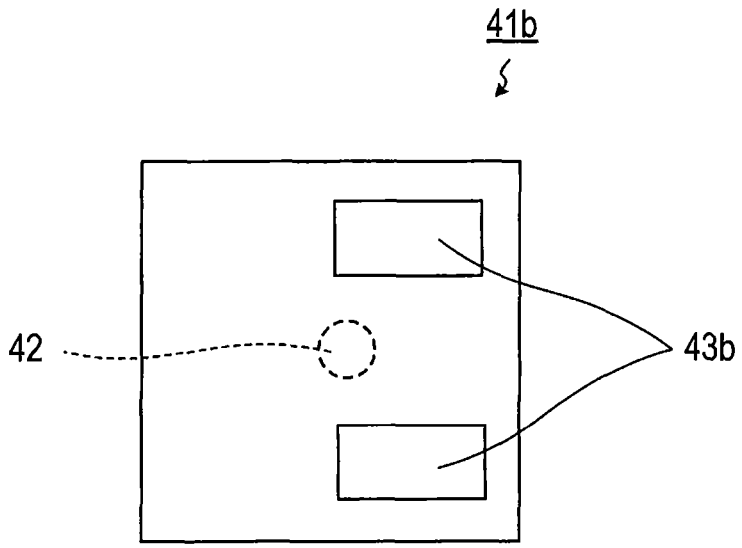
FIG. 9 is an explanatory view showing a variant of the antenna pattern.

(b) In the above-described embodiment, in the antenna pattern 41, the pattern-removed regions 43 are provided on an area having a wide width from the feed point 42 to the outer circumference of the antenna pattern 41 when looking in the x-axis direction from the feed point 42. However, the present disclosure is not limited to this. For example, as in an antenna pattern 41*b* shown in FIG. 9, pattern-removed regions 43*b* may be provided on an area having a narrow width from the feed point 42 to the outer circumference of the antenna pattern 41*b* when looking in the x-axis direction from the feed point 42.

Figure 10:
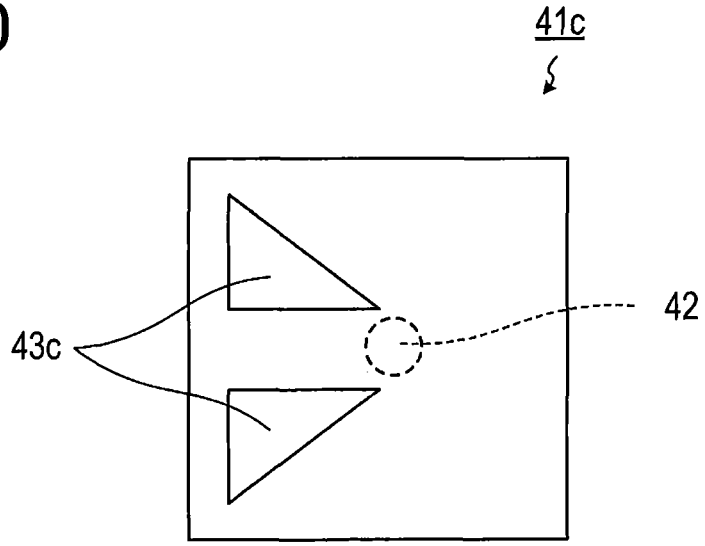
FIG. 10 is an explanatory view showing a variant of the antenna pattern.

(c) In the above-described embodiment, the shape of the pattern-removed regions 43 in the antenna pattern 41 is rectangular. However, the present disclosure is not limited to this. For example, the shape of pattern-removed regions 43*c* may be right-triangular, as in an antenna pattern 41*c* shown in FIG. 10. In addition to this, the shape of the pattern-removed regions may be pentagonal or more polygonal, circular or elliptical, or a combination of these shapes. When the pattern-removed regions each have a shape having a specific side which is a linear side, the pattern-removed regions are desirably arranged in such a manner that the specific side defines the boundary of the line pattern Pu.

Figure 11:
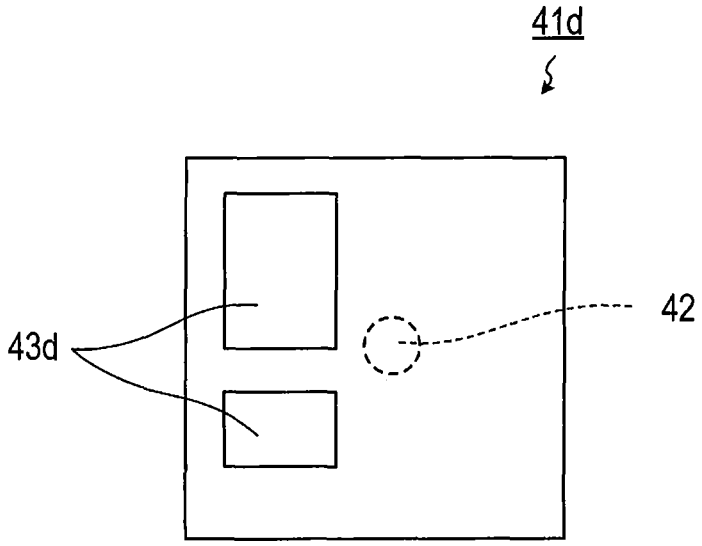
FIG. 11 is an explanatory view showing a variant of the antenna pattern.

(d) In the above-described embodiment, the plurality of pattern-removed regions 43 in the antenna pattern 41 are formed so as to have the same shape and size. However, the present disclosure is not limited to this. For example, a plurality of pattern-removed regions 43*d* may be different in size, as in an antenna pattern 41*d* shown in FIG. 11. Alternatively, the plurality of pattern-removed regions may be mutually different not only in size, but also in shape.

Figure 12:
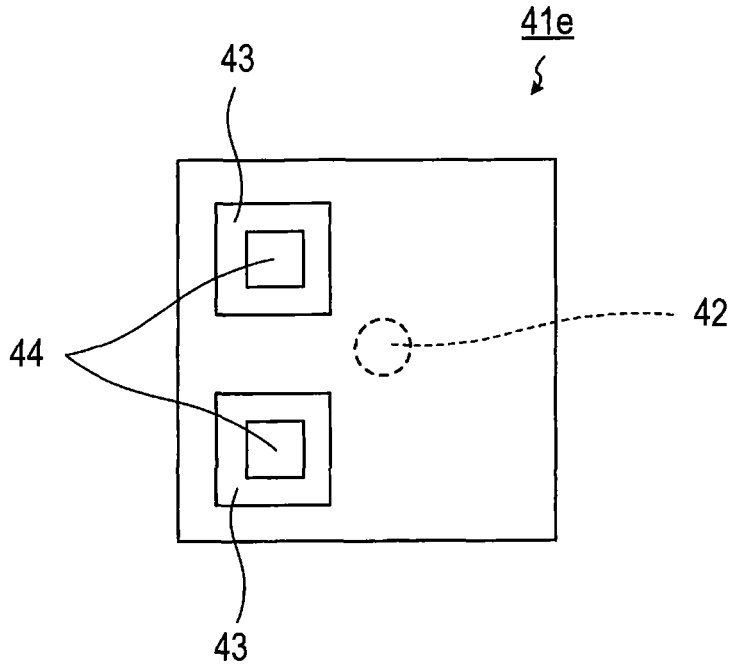
FIG. 12 is an explanatory view showing a variant of the antenna pattern.

(e) In the above-described embodiment, the pattern has been simply removed in the pattern-removed regions 43 of the antenna pattern 41. However, the present disclosure is not limited to this. For example, an internal pattern 44 which is electrically isolated from an antenna pattern 41*e* may be formed within each pattern-removed region 43, as in an antenna pattern 41*e* shown in FIG. 12. In this case, the internal pattern 44 may have a shape similar to that of the pattern-removed region 43 or any other shape.

Figure 13:
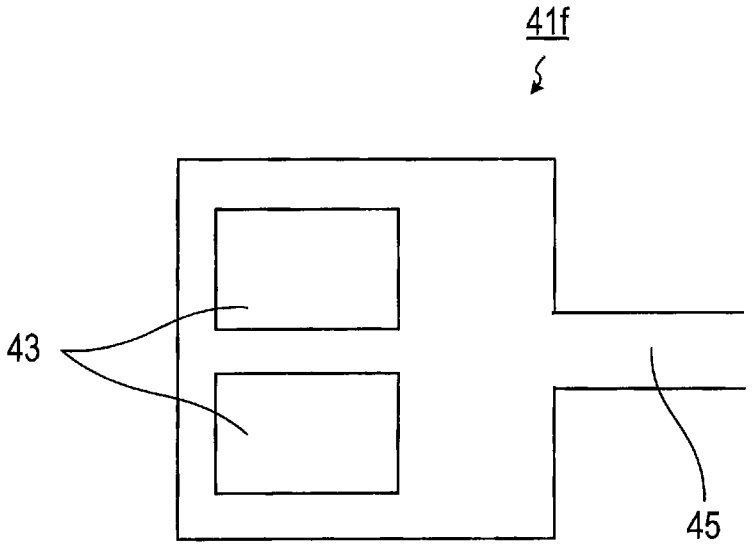
FIG. 13 is an explanatory view showing a variant of the antenna pattern.

(f) In the above-described embodiment, the antenna pattern 41 is configured to receive supplied power from the substrate rear surface 2*b* to the feed point 42. However, the present disclosure is not limited to this. For example, the antenna pattern may be configured to receive supplied power via a feed line pattern 45 provided on the substrate front surface 2*a*, as in an antenna pattern 41*f* shown in FIG. 13.

Figure 14:
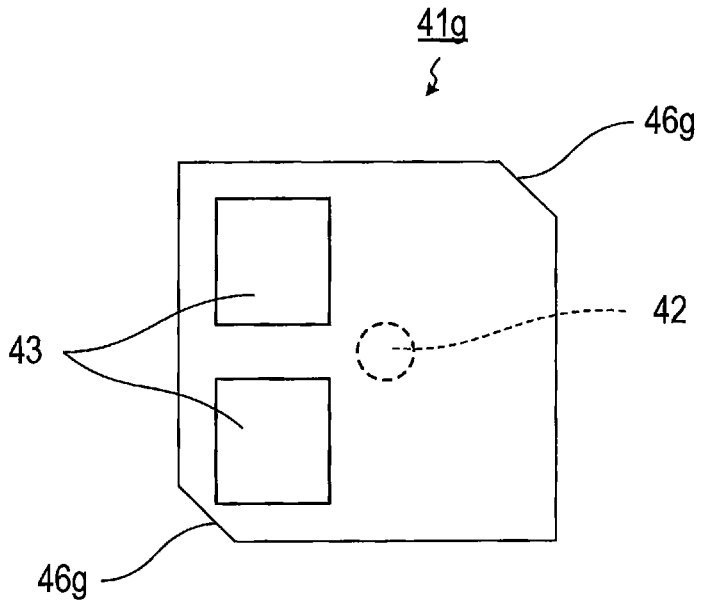
FIG. 14 is an explanatory view showing a variant of the antenna pattern.
Figure 15:
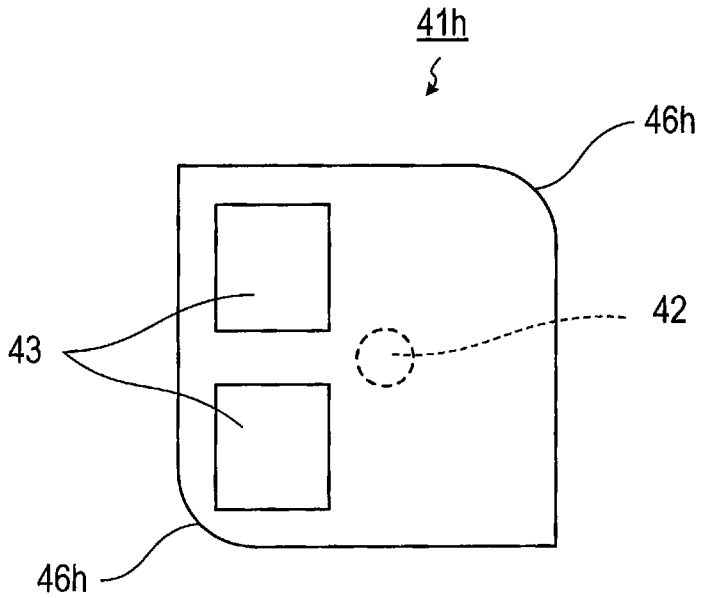
FIG. 15 is an explanatory view showing a variant of the antenna pattern.

(g) In the above-described embodiment, the antenna pattern 41 is configured to transmit/receive electromagnetic waves which are linearly polarized waves. However, the present disclosure is not limited to this. For example, as in an antenna pattern 41*g* shown in FIG. 14 or an antenna pattern 41*h* shown in FIG. 15, the antenna pattern may be configured to transmit/receive circularly or elliptically polarized waves by forming notch parts 46*g* or 46*h* at a pair of apex portions positioned on a diagonal line of the antenna pattern 41*g* or 41*h*. The notch parts 46*g* shown in FIG. 14 each have a shape in which an area near the apex is cut out linearly, and the notch parts 46*h* shown in FIG. 15 each have a shape in which an area near the apex is cut out arcuately.

(h) A plurality of functions of one constituent element in the above embodiment may be realized by a plurality of constituent elements, or one function of one constituent element may be realized by a plurality of constituent elements. In addition, a plurality of functions of a plurality of constituent element may be realized by one constituent element, or one function realized by a plurality of constituent elements may be realized by one constituent element. Moreover, a part of the components of the above-described embodiment may be omitted. Furthermore, at least a part of the components of the above-described embodiment may be added to or replaced with the components of another embodiment described above. Incidentally, all aspects included in the technical idea specified from the language described in the claims are embodiments of the present disclosure.

(i) In addition to the antenna device described above, the present disclosure can also be realized in various forms, such as a system including the antenna device as a component.

What is claimed is:

1. An antenna device comprising:

a dielectric substrate;

an antenna part formed on a first surface of the dielectric substrate and having one or more antenna patterns configured to act as radiating elements, the one or more antenna patterns configured to transmit and receive electromagnetic waves, the one or more antenna patterns configured to resonate in a resonance direction to generate polarized waves that are different from the electromagnetic waves, the resonance direction extending in an x-axis direction; and a base plate formed on a second surface of the dielectric substrate and configured to act as an antenna ground contact surface, wherein the one or more antenna patterns are each formed in a shape comprising at least one line pattern, the at least one line pattern having a width along a y-axis direction that is narrower than a total width of the respective antenna pattern, wherein the y-axis direction is perpendicular to the x-axis direction of the resonance direction, the at least one line pattern comprise one or more pattern-removed regions in which a pattern has been removed in a preset hole shape, and the one or more pattern-removed regions is formed on the respective antenna pattern at a position that is shifted along the x-axis direction such that the one or more pattern-removed regions is formed on only one side of the respective antenna pattern relative to a center of the respective antenna pattern, a feed point of the respective antenna pattern is arranged at a position on the respective antenna pattern that is shifted in the x-axis direction from the center of the respective antenna pattern, the respective antenna pattern comprises a first area that spans from the feed point to a first end of the outer circumference of the antenna pattern and a second area that spans from the feed point to a second end of the outer circumference of the antenna pattern, the second end being opposite of the first end, a distance from the feed point to the first end in the x-axis direction being less than a distance from the feed point to the second end, and the at least one line pattern is provided in the second area.

2. The antenna device according to claim 1, wherein the at least one line pattern is provided at least on a virtual line along the resonance direction passing through a feed point of the respective antenna pattern.

3. The antenna device according to claim 1, wherein the at least one line pattern is provided at least between the respective one or more pattern-removed regions and an outer periphery of the respective antenna pattern.

4. The antenna device according to claim 1, wherein the at least one line pattern is provided at least between the two or more pattern-removed regions.

5. The antenna device according to claim 1, wherein the one or more pattern-removed regions are each formed in a polygonal shape having at least a specific side which is a side along the resonance direction, and arranged in such a manner that the specific side forms a boundary of the line pattern.

6. The antenna device according to claim 1, further comprising an internal pattern formed in the respective one or more pattern-removed regions, the internal pattern being electrically isolated from the respective antenna pattern.

7. The antenna device according to claim 6, wherein the internal pattern has a shape similar to an outer shape of the one or more pattern-removed regions.

8. An antenna device comprising:

a dielectric substrate;

an antenna part formed on a first surface of the dielectric substrate and having one or more antenna patterns configured to act as radiating elements, the one or more antenna patterns configured to transmit and receive electromagnetic waves, the one or more antenna patterns configured to resonate in a resonance direction to generate polarized waves that are different from the electromagnetic waves, the resonance direction extending in an x-axis direction; and a base plate formed on a second surface of the dielectric substrate and configured to act as an antenna ground contact surface, wherein the one or more antenna patterns are each formed in a shape comprising at least one line pattern, the at least one line pattern having a width along a y-axis direction that is narrower than a total width of the respective antenna pattern, wherein the y-axis direction is perpendicular to the x-axis direction of the resonance direction, the at least one line pattern comprise one or more pattern-removed regions in which a pattern has been removed in a preset hole shape, the one or more pattern-removed region is formed on the respective antenna pattern at a position that is shifted along the x-axis direction such that the one or more pattern-removed regions is formed on only one side of the respective antenna pattern relative to a center of the respective antenna pattern, a feed point of the respective antenna pattern is formed at a position on the respective antenna pattern that is shifted in the x-axis direction from the center of the respective antenna pattern, the respective antenna pattern comprises a first area that spans from the feed point to a first end of the outer circumference of the antenna pattern and a second area that spans from the feed point to a second end of the outer circumference of the antenna pattern, the second end being opposite of the first end, a distance from the feed point to the first end in the x-axis direction being less than a distance from the feed point to the second end when looking in the resonance direction from the feed point, and the at least one line pattern is provided in the first area.

* * * * *